US006365876B1

(12) United States Patent
Park

(10) Patent No.: US 6,365,876 B1
(45) Date of Patent: Apr. 2, 2002

(54) CABINET WITH CONVECTIVELY HEATED EXTERIOR AND INTERIOR MIRRORS

(75) Inventor: Hubert Park, Fountain Valley, CA (US)

(73) Assignee: Parkson Industries, Inc., Fountain Valley, CA (US)

( * ) Notice: Subject to any disclaimer, the term of this patent is extended or adjusted under 35 U.S.C. 154(b) by 0 days.

(21) Appl. No.: 09/940,239

(22) Filed: Aug. 27, 2001

(51) Int. Cl.[7] ..... H05B 3/84

(52) U.S. Cl. ..... 219/219; 219/522; 219/544; 219/549; 359/509; 359/512

(58) Field of Search ..... 219/218, 219, 219/522, 544, 543, 541, 542, 520, 549, 202, 203; 359/512–514, 509

(56) References Cited

U.S. PATENT DOCUMENTS 3,887,788 A * 6/1975 Seibel et al. ..... 219/219
4,060,712 A * 11/1977 Chang ..... 219/219
4,631,391 A 12/1986 Tiepke
4,940,317 A 7/1990 Reuben
5,155,334 A 10/1992 Marstiller et al.
5,302,809 A 4/1994 Ghiassy
5,380,981 A 1/1995 Feldman et al.
5,406,049 A * 4/1995 Reiser et al. ..... 219/219
5,467,423 A 11/1995 Jakubowski
5,731,569 A * 3/1998 Crescenzo ..... 219/219
5,821,501 A 10/1998 Zorn
5,852,284 A 12/1998 Teder et al.
5,904,874 A * 5/1999 Winter ..... 219/544
5,953,157 A * 9/1999 Christianson ..... 359/509
6,144,017 A * 11/2000 Millett et al. ..... 219/522
6,198,073 B1 * 3/2001 Gonzalez ..... 219/219

* cited by examiner

*Primary Examiner*—Teresa Walberg
*Assistant Examiner*—Shawntina Fuqua
(74) *Attorney, Agent, or Firm*—Edward Gray

(57) ABSTRACT

A wall-mounted cabinet having a pivotable door with opposed exterior and interior mirrors which can be convectively and radiatively heated to prevent fogging, by a sheet heater between the two mirrors. The exterior mirror is electrically insulated, and the exterior and interior mirrors are grounded to prevent electric shock.

8 Claims, 4 Drawing Sheets

CABINET WITH CONVECTIVELY HEATED EXTERIOR AND INTERIOR MIRRORS

BACKGROUND OF THE INVENTION

1. Field of the Invention

This invention relates to cabinets with mirrored doors such as are installed in bathrooms, and more particularly to a cabinet having a door with opposed exterior and interior mirrors heated to a temperature exceeding ambient temperature to prevent fogging when water vapor is in the air.

2. Description of the Related Art

Devices for electrically heating and thereby defogging mirrors in warm and humid environments such as bathrooms have been disclosed in many patents. U.S. Pat. No. 4,665,304 to A. G. Spencer, directed to an electrical sheet heater sufficiently thin that it can be mounted behind a sheet of conventional mirror glass without preventing the use of standard mirror mounting hardware or frames, provides an extensive survey of the U.S. patent literature up to 1984. Spencer observed that although numerous proposals had been made to heat bathroom mirrors above the dew point so as to prevent condensation, none of these met with substantial commercial success.

More recently, U.S. Pat. No. 4,940,317 to R. Reuben discloses a heating device secured to a rear coated surface of a mirror, which includes two conductive strips attached at opposed edges of the coated surface and a resistive conductor element extending between the two strips. U.S. Pat. No. 5,155,334 to J. A. Marstiller et al. is directed to an electrical sheet heater attached to a sheet of insulating material that can be mounted on a wall or attached to a mirror back before the miror is mounted or hung in place. U.S. Pat. No. 5,302,809 to A. Ghiassy is directed to a planar resistive sheet heater which extends downwardly from and is supported by an elongated frame member disposed along the top of a wall-mounted mirror. U.S. Pat. No. 5,380,981 to B. Feldman et al. discloses an electric heating unit for attachment to a rear surface of a mirror which operates at low voltage and restricts the size of the heated area to conserve power. The unit includes a heat barrier formed of a layer of closed cell plastic foam, an insulated low resistance heater wire mounted on the surface of the foam layer, aluminum foil covering the wire and foam surface, and an adhesive layer with peel-off backing to permit attachment of the unit to a mirror. U.S. Pat. No. 5,821,501 to H. Zorn discloses a heated exterior mirror for motor vehicles which includes a mirror glass with a transparent conductive coating on its front surface divided into two zones by a narrow non-conductive gap, an electrical heater thermally bonded to the glass front surface behind a reflective coating, and an electrical circuit connected between the two zones to sense changes in resistance and/or capacitance of the gap due to deposition of moisture on the front surface.

U.S. Pat. No. 5,852,284 to R. S. Teder et al. discloses a sheet of low emissivity glass with a resistive coating connected to a power source. A capacitor coupled to the coating is used to increase the impedance and control the power dissipated by the coated glass. When used in an insulating glass unit for commercial freezer and refrigerator doors, the heated glass prevents condensation from forming on the doors.

None of these references addresses the problem of heating two opposed mirrors separated by a small air gap, such as may be installed in bathroom cabinets. Typically, a planar (i.e., non-magnifying) mirror is mounted on or set into the exterior surface of a hinged door, and a smaller, concave magnifying mirror, mounted on or set into the door interior surface, is accessible when shaving or applying cosmetics by opening the door.

Each of the devices in the related art for electrically heating a single mirror is rigidly attached to or is otherwise in good thermal contact with a mirror surface so that heating occurs by conduction. For a door-mounted double mirror assembly, the spacing between the mirrors can be no greater than the door frame width, so using two laterally juxtaposed heaters would be infeasible in addition to being wasteful of energy. What is needed is a device which fits within the door frame and simultaneously heats both mirrors. A second problem arises because the parallel configuration of the mirrors and the materials used in their manufacture form a capacitor which can cause an electrical shock even when power is switched off. A mirror is made by first polishing one surface of a glass blank with an abrasive slurry which exposes a virgin surface to which is applied, after polishing and rinsing, a "tinning" solution of stannous chloride ($SnCl_2$). Next, a solution of silver nitrate ($AgNO_3$) is poured or sprayed onto the tinned surface to form a reflective surface which is then rinsed with deionized water. The silver coating is protected by a coating of copper sulfate ($CuSO_4$) followed by one or more layers of protective ("mirror-backing") paint. Because the stannous chloride, silver nitrate and copper sulfate layers are electrically conductive, a capacitor is formed. The charge stored in a capacitor is the product of its capacitance and the source voltage (here, 110–120 volts). Capacitance equals the product of plate area and dielectric constant (a measure of the ability of a material to hold electric charge without allowing current flow), divided by the distance between the plates. Since the plate areas (i.e., the metallic coating areas) are large and their spacing is small, considerable charge can be stored in a cabinet-sized dual mirror assembly heated by household current even when there is no dielectric other than air between the coatings. Consequently, a manufacturer of such cabinets must incorporate elements which eliminate the possibility of electric shock.

OBJECTS OF THE INVENTION

In view of the limitations of the related art, it is an object of the present invention to provide a cabinet with exterior and interior mirrors, mounted on a pivotable door, which can be defogged by a single electrical heating device mounted within the frame.

Another object of the invention is to provide a cabinet with exterior and interior mirrors which are mounted on a pivotable door protected against electrical shock.

A further object of the invention is to provide a cabinet with heatable exterior and interior mirrors in a door-mounted assembly that can be easily manufactured using high quality components.

Yet another object of the invention is to provide a cabinet with exterior and interior mirrors which can be reliably defogged in a warm, humid environment.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

These and other objects are achieved by the present invention which in one aspect provides a cabinet including a cabinet body having a rectangular rear wall and a cabinet door pivotally attached to the body. The door includes a frame having parallel top and bottom portions and parallel left and right portions orthogonal to the top and bottom portions, the four portions determining a rectangular aperture. The door further includes: an exterior mirror having parallel exterior and interior surfaces bounded by top, left, bottom and right edges, with the interior surface circumferentially attached to the four frame portions; and an opposed interior mirror having parallel exterior and interior surfaces bounded by top, left, bottom and right edges, with the interior surface circumferentially attached to the four frame portions. The interior surfaces of the exterior and interior mirrors are parallel and separated by an air gap. The door further includes means for convectively and radiatively heating the mirrors.

In another aspect the invention provides a wall-mounted cabinet including a cabinet body having a rectangular rear wall and a cabinet door pivotally attached to the body. The door includes a frame having parallel top and bottom portions and parallel left and right portions orthogonal to the top and bottom portions, the four portions determining a rectangular aperture. The door further includes: an exterior mirror having parallel exterior and interior surfaces bounded by top, left, bottom and right edges, with the interior surface circumferentially attached to the four frame portions; and an opposed interior mirror having parallel exterior and interior surfaces bounded by top, left, bottom and right edges, with the interior surface circumferentially attached to the four frame portions. The interior surfaces of the mirrors are parallel and separated by an air gap. The door further includes a rectangular, electrically non-conductive spacer having a circumferential groove determining a rectangular aperture. The spacer is symmetrically disposed within the frame aperture and is interposed between and maintains rigid parallel alignment of the mirrors. The door further includes a rectangular sheet heater having a blanket with opposed electrically non-conductive surfaces, and a bottom edge proximate to which are attached two electrical terminals. The heater is rigidly disposed within the circumferential groove so that the blanket surfaces are equidistant from the mirror interior surfaces.

In yet another aspect the invention provides a wall-mounted cabinet including a cabinet body having a rectangular rear wall and a cabinet door pivotally attached to the body. The door includes a frame having parallel top and bottom portions and parallel left and right portions orthogonal to the top and bottom portions, the four portions determining a rectangular aperture. The door further includes an exterior mirror having parallel exterior and interior surfaces bounded by top, left, bottom and right edges coated with a layer of electrically non-conductive material. The bottom edge is closely received within and attached to a first J-shaped metallic foil. The interior surface is circumferentially attached to the four frame portions. The door further includes an opposed interior mirror having parallel exterior and interior surfaces bounded by top, left, bottom and right edges, with the interior surface circumferentially attached to the four frame portions. The bottom edge is closely received within and attached to a second J-shaped metallic foil. The interior surfaces of the mirrors are parallel and separated by an air gap. The door further includes a rectangular, electrically non-conductive spacer having a circumferential groove determining a rectangular aperture. The spacer is symmetrically disposed within the frame aperture and is interposed between and maintains rigid parallel alignment of the mirrors. The door further includes a rectangular sheet heater having a blanket with opposed electrically non-conductive surfaces, and a bottom edge proximate to which are attached two electrical terminals. The heater is rigidly disposed within the spacer circumferential groove so that the blanket surfaces are equidistant from the mirror interior surfaces.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
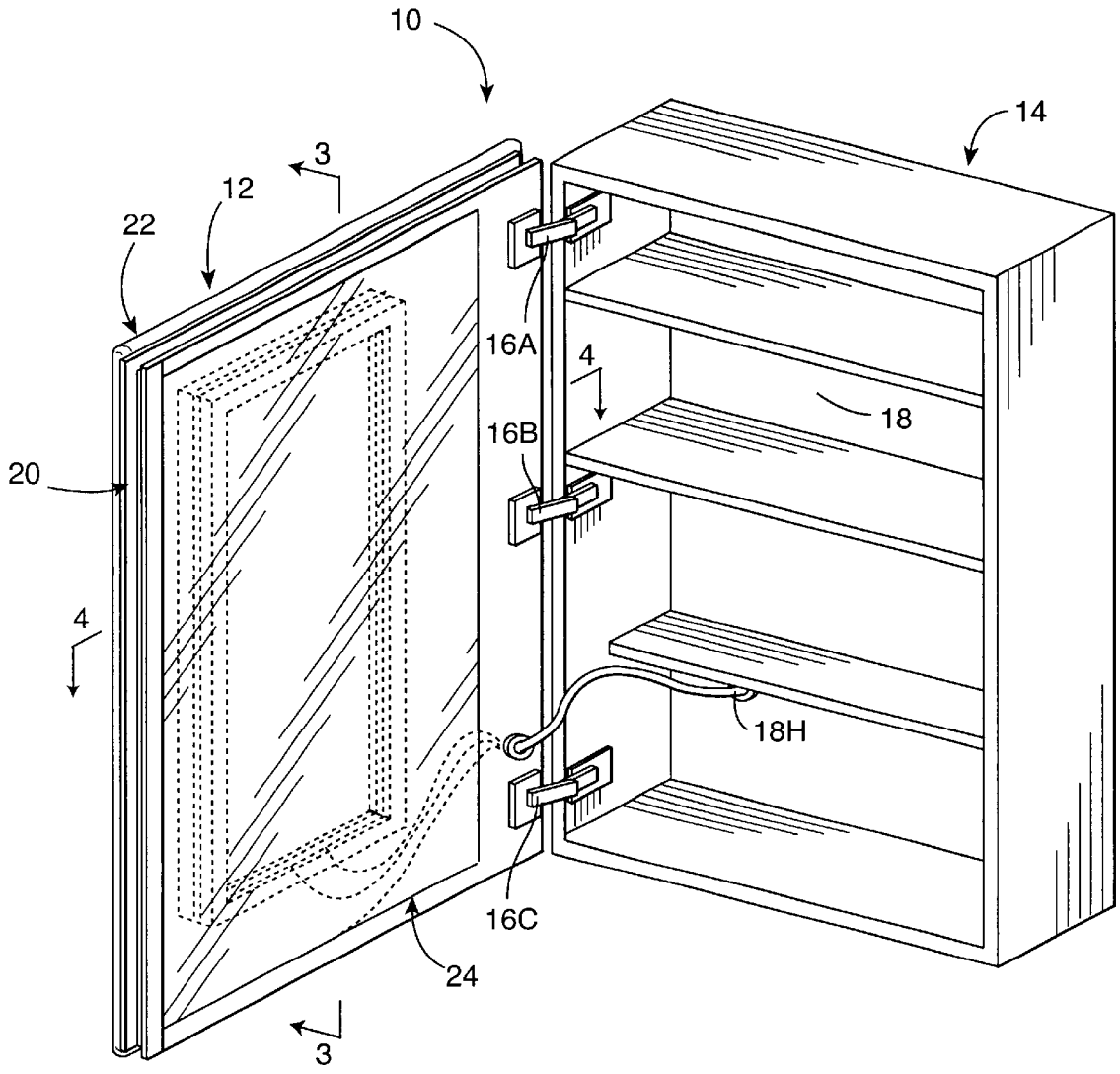
FIG. 1 is a perspective view of a cabinet according to the invention, having a hinged door including opposed exterior and interior mirrors attached to a frame, and an electrical sheet heater mounted within a spacer disposed within the frame and between the two mirrors.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

Where used herein, the word "attached" means that the two parts referred to are either fabricated in a single piece, or bonded, screwed, soldered or clamped together. However, other forms of attachment may be suitable, consistent with simplicity of manufacture and reliability of operation.

Referring to FIG. 1, a cabinet 10 according to the invention includes a cabinet door 12 pivotally attached to a cabinet body 14 by hinges 16A, 16B, 16C. Body 14 includes a generally rectangular rear wall 18, with a hole 18H therethrough, which typically is attached to a bathroom wall. Door 12 includes a generally rectangular frame 20 to which are attached a generally rectangular exterior mirror 22 and an opposed generally rectangular interior mirror 24.

Figure 2:
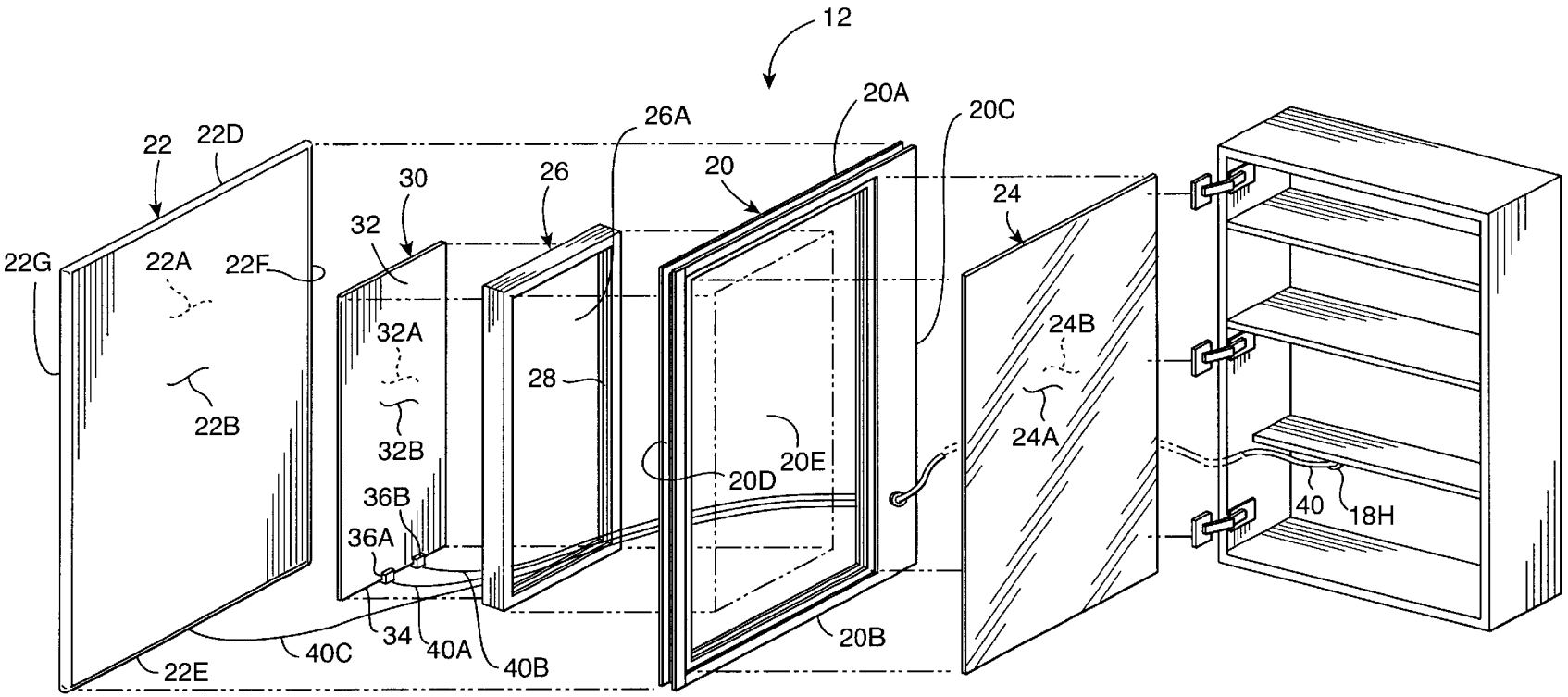
FIG. 2 is an exploded perspective view of the FIG. 1 cabinet showing the exterior mirror, heater, spacer, frame, and interior mirror.
Figure 3:
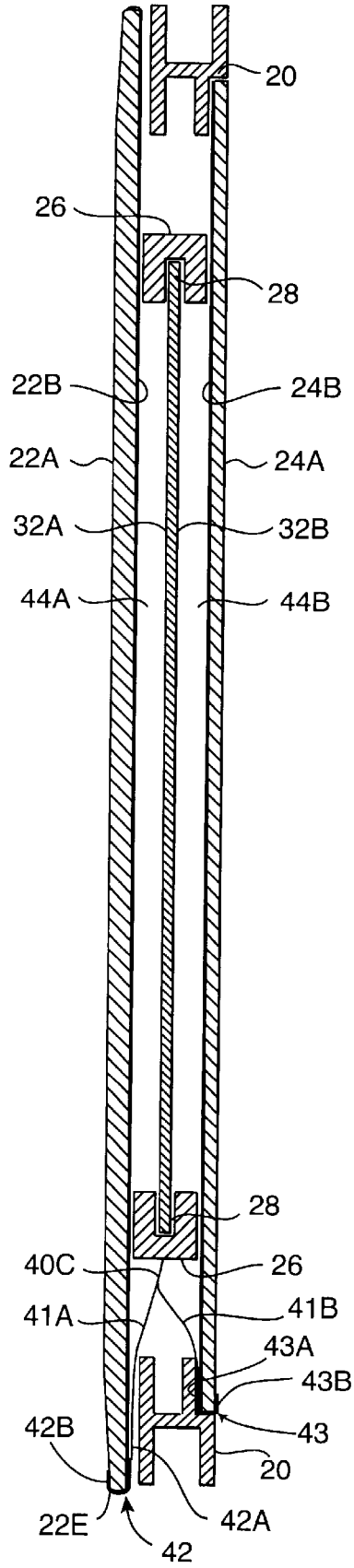
FIG. 3 is a sectional view taken along line 3—3 in FIG. 1, showing the heater mounted within the spacer.
Figure 4:
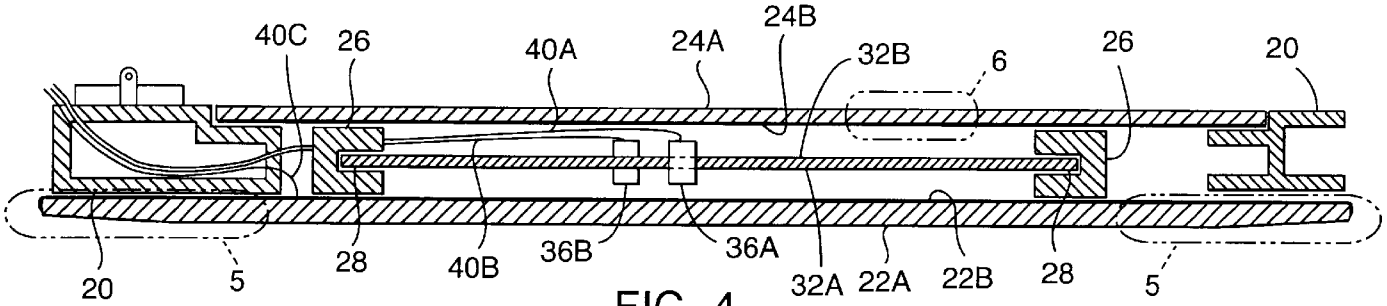
FIG. 4 is a sectional view taken along line 4—4 in FIG. 1, showing the exterior and interior mirrors and frame, the FIG. 3 spacer, and two electrical terminals.

Referring to FIGS. 2, 3 and 4, frame 20 includes planar, parallel top and bottom portions 20A, 20B, respectively, and planar, parallel left and right portions 20C, 20D, respectively, generally orthogonal to portions 20A, 20B. The four portions determine a generally rectangular aperture 20E. Mirror 22 has an exterior surface 22A, an interior surface 22B, top and bottom edges 22D, 22E, respectively, and left and right edges 22F, 22G, respectively. Mirror 24 has an exterior surface 24A and an interior surface 24B. Opposed surfaces 22B and 24B are each circumferentially attached to frame portions 20A, 20B, 20C, 20D. Preferably, the mirrors are each about 3 to 4 millimeters (mm) in thickness. A generally rectangular, electrically non-conductive spacer 26, symmetrically disposed within aperture 20E, is interposed between and maintains rigid the parallel alignment of mirrors 22, 24. Spacer 26 has a circumferential groove 28, determining a generally rectangular aperture 26A, within which is closely received a thin, generally rectangular sheet heater 30 including a blanket 32 with opposed electrically non-conductive surfaces 32A, 32B, and a bottom edge 34 proximate to which are attached electrical terminals 36A, 36B. Heater 30 is rigidly disposed within groove 28 so that the separations between surfaces 32A, 22B and surfaces 32B, 24B are equal. Preferably, heater 30 has a resistive heating element made of NICHROME™ wire having a thickness between 0.25 and 0.30 mm. Blanket 32 is made from a silicone rubber material and has a thickness in a range from about 1.0 to about 1.5 mm. Preferably, the separation between mirror surfaces 22B and 24B is 9 to 10 mm, so that the gap between each interior mirror surface and the proximate heater blanket surface is about 3.7 to about 4.5 mm. Preferably, frame 20 is made from an aluminum alloy, wood or a plastic, and spacer 26 is made from a polycarbonate plastic. A non-metallic sheathed electrical cable 40, connected to 110–120 volt alternating current and fed through hole 18H, terminates in a positive (hot) wire 40A attached to terminal 36A, a negative (neutral) wire 40B attached to terminal 36B, and a ground wire 40C having bifurcated ends 41A, 41B. End 41A is attached to a rear portion 42A of a first "J"-shaped thin copper foil 42, arcuately extending in a front portion 42B, which closely receives and is attached to bottom edge 22E of mirror 22 (see FIG. 3). Similarly, end 41B is attached to a rear portion 43A of a second "J"-shaped thin copper foil 43, extending in a front portion 43B, which closely receives and is attached to the bottom edge of mirror 24. Preferably, foils 42, 43 are each about 10 centimeters (cm) in width, portions 42A, 43A are each about 22 to 23 mm in length, and portions 42B, 43B are each about 3 mm in length. Wires 40A, 40B are conveniently attached to the heater terminals via an ON/OFF switch controlling the room lighting. Alternatively, the wires may be attached to an ON/OFF switch mounted within the cabinet body 14. Because heater 30 is isolated from mirrors 22, 24 by air gaps 44A, 44B, respectively, the mirrors are heated convectively and by direct radiation, rather than conductively as in all of the related art devices.

Figure 5:
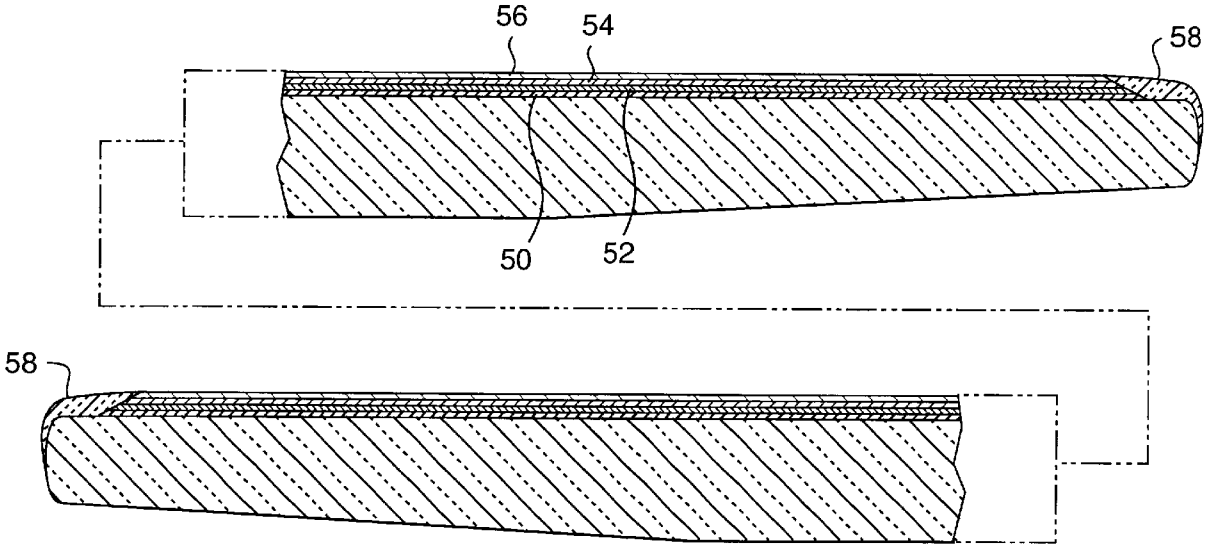
FIG. 5 is an enlarged detail view of the oval regions "5" in FIG. 4, showing the stannous chloride, silver nitrate, copper sulfate, and protective paint coatings on the interior surface of the exterior mirror, and an electrically non-conductive coating at each mirror edge.

Referring to FIG. 5, a first coating 50 of stannous chloride is attached to interior surface 22B of exterior mirror 22, followed by a second coating 52 of silver nitrate, a third coating 54 of copper sulfate, and a fourth coating 56 of protective paint. Edges 22D, 22E, 22F and 22G are each coated with a layer of electrically non-conductive material 58. Circumferential layer 58 and ground wire 40C ensure that a person touching mirror surface 22A or 24A cannot receive an electric shock.

Figure 6:
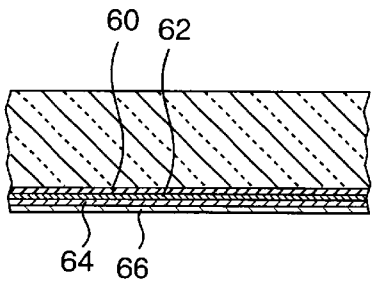
FIG. 6 is an enlarged detail view of the oval region "6" in FIG. 4, showing the stannous chloride, silver nitrate, copper sulfate, and protective paint coatings on the interior surface of the interior mirror.

Referring to FIG. 6, a first coating 60 of stannous chloride is attached to interior surface 24B of interior mirror 24, followed by a second coating 62 of silver nitrate, a third coating 64 of copper sulfate, and a fourth coating 66 of protective paint.

What is claimed is:

1. A cabinet comprising a cabinet body having a generally planar, generally rectangular rear wall and a cabinet door pivotally attached to the body, the door comprising:

a frame having generally planar, generally parallel top and bottom portions and generally planar, generally parallel left and right portions orthogonal to the top and bottom portions, the top, left, bottom and right portions determining a generally rectangular aperture;

an exterior mirror having an exterior surface and an interior surface, the surfaces generally, parallel and bounded by top, left, bottom and right edges, the interior surface circumferentially attached to the top, left, bottom and right frame portions;

an interior mirror, opposed to the exterior mirror, having an exterior surface and an interior surface, the surfaces generally parallel and bounded by top, left, bottom and right edges, the interior surface circumferentially attached to the top, left, bottom and right frame portions, the interior surfaces of the exterior and interior mirrors generally parallel and having a predetermined separation; and means for convectively and radiatively heating the exterior and interior mirrors.

2. The cabinet of claim 1, wherein said means for heating the mirrors is a generally planar sheet heater interposed between and generally parallel to the two mirrors, and separated from the interior surface of each mirror by a predetermined air gap.

3. A wall-mounted cabinet comprising a cabinet body having a generally planar, generally rectangular rear wall and a cabinet door pivotally attached to the body, the door comprising:

a frame having generally planar, generally parallel top and bottom portions and generally planar, generally parallel left and right portions orthogonal to the top and bottom portions, the top, left, bottom and right portions determining a generally rectangular aperture;

an exterior mirror having an exterior surface and an interior surface, the surfaces generally parallel and bounded by top, left, bottom and right edges, the interior surface circumferentially attached to the top, left, bottom and right frame portions;

an interior mirror, opposed to the exterior mirror, having an exterior surface and an interior surface, the surfaces generally parallel and bounded by top, left, bottom and right edges, the interior surface circumferentially attached to the top, left, bottom and right frame portions, the interior surfaces of the exterior and interior mirrors generally parallel and having a predetermined separation;

a generally rectangular, electrically non-conductive spacer having a circumferential groove determining a generally rectangular aperture, the spacer symmetrically disposed within the frame aperture and interposed between and maintaining rigid the parallel alignment of the exterior and interior mirrors; and a generally rectangular sheet heater having a blanket of a predetermined thickness with opposed electrically non-conductive first and second surfaces, and a bottom edge proximate to which are attached first and second electrical terminals, the heater rigidly disposed within the circumferential groove, the first and second surfaces equidistant by a predetermined air gap from, respectively, the interior surfaces of the exterior and interior mirrors.

4. The cabinet of claim 3, wherein:

the spacer is made from a polycarbonate plastic;

the separation between the interior surfaces of the exterior and interior mirrors is in a range from about 9 to about 10 millimeters;

the heater blanket thickness is in a range from about 1.0 to about 1.5 millimeters; and the air gap between each mirror interior surface and the proximate heater blanket surface is in a range from about 3.7 to about 4.5 millimeters.

5. A wall-mounted cabinet comprising a cabinet body having a generally planar, generally rectangular rear wall and a cabinet door pivotally attached to the body, the door comprising:

a frame having generally planar, generally parallel top and bottom portions and generally planar, generally parallel left and right portions orthogonal to the top and bottom portions, the top, left, bottom and right portions determining a generally rectangular aperture;

an exterior mirror having an exterior surface and an interior surface, the surfaces generally parallel and bounded by top, left, bottom and right edges coated with a layer of electrically non-conductive material, the bottom edge closely received within and attached to a first J-shaped metallic foil, the interior surface circumferentially attached to the top, left, bottom and right frame portions;

an interior mirror, opposed to the exterior mirror, having an exterior surface and an interior surface, the surfaces generally parallel and bounded by top, left, bottom and right edges, the interior surface circumferentially attached to the top, left, bottom and right frame portions, the bottom edge closely received within and attached to a second J-shaped metallic foil, the interior surfaces of the exterior and interior mirrors generally parallel and having a predetermined separation;

a generally rectangular, electrically non-conductive spacer having a circumferential groove determining a generally rectangular aperture, the spacer symmetrically disposed within the frame aperture and interposed between and maintaining rigid the parallel alignment of the exterior and interior mirrors; and a generally rectangular sheet heater having a blanket of a predetermined thickness with opposed electrically non-conductive first and second surfaces, and a bottom edge proximate to which are attached first and second electrical terminals, the heater rigidly disposed within the circumferential groove, the first and second surfaces equidistant by a predetermined air gap from, respectively, the interior surfaces of the exterior and interior mirrors.

6. The cabinet of claim 5, wherein the sheet heater comprises a resistive heating element made from a NICHROME™ wire, the heater blanket is made of a silicone rubber, the separation between the interior surfaces of the exterior and interior mirrors is about 9 to about 10 millimeters, the heater blanket thickness is in a range from about 1.0 to about 1.5 millimeters, and the air gap between each blanket surface and the proximate mirror interior surface is in a range from about 3.7 to about 4.5 millimeters.

7. The cabinet of claim 6, wherein the first and second heater electrical terminals are attached, respectively, to positive and negative wires carrying 110–120 volt alternating current, and the J-shaped metallic foils are attached to a ground wire.

8. The cabinet of claim 7, wherein the interior surfaces of the exterior and interior mirrors each have attached thereto a first coating of stannous chloride, a second coating of silver nitrate, a third coating of copper sulfate, and a fourth coating of protective paint.

* * * * *